US011225389B2

(12) United States Patent
Ono

(10) Patent No.: US 11,225,389 B2
(45) Date of Patent: Jan. 18, 2022

(54) IMAGE FORMING APPARATUS

(71) Applicant: Brother Kogyo Kabushiki Kaisha, Nagoya (JP)

(72) Inventor: Hiroshi Ono, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 99 days.

(21) Appl. No.: 16/695,345

(22) Filed: Nov. 26, 2019

(65) Prior Publication Data

US 2020/0172362 A1 Jun. 4, 2020

(30) Foreign Application Priority Data

Nov. 29, 2018 (JP) ..... JP2018-223904

(51) Int. Cl.

| | |
|---|---|
| ***B65H 7/04*** | (2006.01) |
| ***B65H 7/20*** | (2006.01) |
| ***B65H 1/26*** | (2006.01) |
| ***B65H 7/02*** | (2006.01) |
| *B65H 1/14* | (2006.01) |

(52) U.S. Cl.

CPC ..... *B65H 7/04* (2013.01); *B65H 1/266* (2013.01); *B65H 7/02* (2013.01); *B65H 7/20* (2013.01); *B65H 1/14* (2013.01); *B65H 2511/152* (2013.01); *B65H 2511/51* (2013.01); *B65H 2511/515* (2013.01); *B65H 2515/712* (2013.01); *B65H 2553/23* (2013.01)

(58) Field of Classification Search

CPC . B65H 7/04; B65H 1/266; B65H 7/20; B65H 2553/232; B65H 2511/51; B65H 2511/515; B65H 2553/23; B65H 2515/712; B65H 2511/152

See application file for complete search history.

(56) References Cited

U.S. PATENT DOCUMENTS

| | | | | |
|---|---|---|---|---|
| 6,625,561 | B1 | 9/2003 | Tullis | |
| 10,308,451 | B2 * | 6/2019 | Kikuta | B65H 7/02 |
| 2015/0183596 | A1 * | 7/2015 | Shimazu | B65H 1/18 271/153 |

FOREIGN PATENT DOCUMENTS

| | | | |
|---|---|---|---|
| JP | 2004-149245 | A | 5/2004 |
| JP | 2004-517015 | A | 6/2004 |
| JP | 2016-124654 | A | 7/2016 |
| JP | 2017-030912 | A | 2/2017 |

* cited by examiner

*Primary Examiner* — Jeremy R Severson
(74) *Attorney, Agent, or Firm* — Burr & Brown, PLLC

(57) ABSTRACT

An image forming apparatus includes a main body, a sheet cassette attachable to the main body and configured to support one or more sheets to be supplied to the image forming unit, and a controller. The main body includes an electrode movable relative to the main body, a capacitance detector configured to output a signal indicating a value corresponding to a quantity of electricity stored in the electrode, and a wire. The sheet cassette includes a metal member, and a sheet supporting plate made of metal, movable relative to the sheet cassette in an up-down direction, and configured to support one or more sheets from below. The controller is configured to determine whether the sheet cassette is at an installation position in the main body from a level of the value of the signal outputted from the capacitance detector connected to the electrode via the wire.

11 Claims, 10 Drawing Sheets

IMAGE FORMING APPARATUS

CROSS-REFERENCE TO RELATED APPLICATION

This application claims priority from Japanese Patent Application No. 2018-223904 filed on Nov. 29, 2018, the content of which is incorporated herein by reference in its entirety.

TECHNICAL FIELD

Aspects of the disclosure relate to an image forming apparatus, for example, a printer.

BACKGROUND

Some known printers for feeding a sheet from a sheet cassette detect the position of the sheet cassette in a printer (or whether the sheet cassette is in or out of the printer) and the remaining amount of sheets in the sheet cassette (or the presence or absence of a sheet) for proper sheet feeding. The position of the sheet cassette in the printer and the remaining amount of sheets in the sheet cassette may be detected using actuators and optical sensors.

For a simplified detection structure, a first related example includes optical sensors and a common actuator to utilize varying combinations of signals outputted from the optical sensors in accordance with the presence or absence of a sheet cassette in a printer and the presence or absence of a sheet in the sheet cassette.

A second related example includes a pair of actuator and optical sensor to detect from a time of change of signals outputted from the optical sensor, the presence or absence of a sheet cassette in a printer and the presence or absence of a sheet in the sheet cassette In the above examples, the presence or absence of a sheet in the sheet cassette can be detected, but the remaining amount of sheets in the sheet cassette cannot be detected. In the second example, delayed timing of change of signals outputted from the optical sensor may cause a false detection.

For accurate detection of the remaining amount of sheets in the sheet cassette, a third related example includes two electrodes each disposed on one of both sides in a direction in which sheets are stacked to utilize a change in the capacitance between the electrodes due to a varying distance between the electrodes.

SUMMARY

The position of the sheet cassette in the printer and the remaining amount of sheets in the sheet cassette may be detected accurately through a combination of the above examples. However, dedicated sensors may be provided for detection on each of the position of the sheet cassette in the printer and the remaining amount of sheets in the sheet cassette.

Aspects of the disclosure provide an image forming apparatus configured to detect the position of a sheet cassette and the remaining amount of sheets in the sheet cassette accurately using a single sensor.

According to an aspect of the disclosure, an image forming apparatus includes a main body, an image forming unit, a sheet cassette, and a controller. The main body includes an electrode movable relative to the main body, a capacitance detector configured to output a signal indicating a value corresponding to a quantity of electricity stored in the electrode, and a wire connecting the electrode and the capacitance detector. The image forming unit is disposed in the main body. The sheet cassette is attachable to the main body and configured to support one or more sheets to be supplied to the image forming unit. The sheet cassette includes a metal member, and a sheet supporting plate that is made of metal, movable relative to the sheet cassette in an up-down direction, and configured to support one or more sheets from below. The controller is disposed in the main body. The main body defines an installation position in which sheets are feedable from the sheet cassette toward the image forming unit. The electrode of the main body is disposed such that, in a state in which the sheet cassette is at the installation position defined in the main body, the electrode of the main body faces the sheet supporting plate in the up-down direction and a distance between the electrode and the metal member is minimal. The controller is configured to, in a case in which the controller determines that the value of the signal outputted from the capacitance detector is below a first value, determine that the sheet cassette is not at the installation position in the main body. The controller is configured to, in a case in which the controller determines that the value of the signal outputted from the capacitance detector is greater than or equal to the first value and below a second value, determine that the sheet cassette is at the installation position. The controller is configured to, in a case in which the controller determines that the value of the signal outputted from the capacitance detector is greater than or equal to the second value and below a third value, determine that the sheet cassette at the installation position stores one or more sheets. The controller is configured to, in a case in which the controller determines that the value of the signal outputted from the capacitance detector is greater than or equal to the third value, determine that the sheet cassette stores no sheets.

Thus, the presence or absence of the sheet cassette at the installation position in the main body and the remaining amount of sheets in the sheet cassette are determined from a level of a value of a signal outputted from the capacitance detector connected to the electrode via the wire. The position of the sheet cassette in the main body and the remaining amount of sheets can be detected by using the single sensor including the electrode, the capacitance detector, and the wire connecting the electrode and the capacitance detector. The presence or absence of the sheet cassette and the remaining amount of sheets are determined in accordance with a level of a value of a signal outputted from the capacitance detector, and thus can be detected accurately as compared with a known structure using a time of change of signals outputted from a sensor.

Thus, the image forming apparatus can detect the position of the sheet cassette in the main body and the remaining amount of sheets in the sheet cassette accurately using a single sensor.

According to another aspect of the disclosure, an image forming apparatus includes a main body, an image forming unit, a sheet cassette, and a controller. The main body includes an electrode movable relative to the main body, a capacitance detector configured to output a signal indicating a value corresponding to a quantity of electricity to be stored in the electrode, and a wire connecting the electrode and the capacitance detector. The image forming unit is disposed in the main body. The sheet cassette is attachable to the main body and configured to support one or more sheets to be supplied to the image forming unit. The sheet cassette includes a metal member and a sheet supporting plate that is made of metal, movable relative to the sheet cassette in an up-down direction, and configured to support one or more sheets from below. The controller is disposed in the main body. The main body defines an installation position in which sheets are feedable from the sheet cassette toward the image forming unit. The electrode of the main body is disposed such that, in a state in which at least the sheet cassette is at the installation position set in the main body, the electrode of the main body faces the sheet supporting plate in the up-down direction. The wire has a particular portion, the particular portion being located such that, in a state in which the sheet cassette is at the installation position, a distance between the particular portion and the metal member is minimal. The controller is configured to, in a case in which the controller determines that the value of the signal outputted from the capacitance detector is below a first value, determine that the sheet cassette is not at the installation position in the main body. The controller is configured to, in a case in which the controller determines that the value of the signal outputted from the capacitance detector is greater than or equal to the first value and below a second value, determine that the sheet cassette is at the installation position. The controller is configured to, in a case in which the controller determines that the value of the signal outputted from the capacitance detector is greater than or equal to the second value and below a third value, determine that the sheet cassette at the installation position supports a sheet. The controller is configured to, in a case in which the controller determines that the value of the signal outputted from the capacitance detector is greater than or equal to the third value, determine that the sheet cassette supports no sheets.

This structure may achieve the similar effects to those achieved by the above aspect of the disclosure.

A quantity of electricity stored in the electrode depends on a capacitance between the electrode and a conductor disposed apart from the electrode (to form a pseudocapacitor with the electrode). A signal corresponding to a quantity of electricity stored in the electrode may be a signal indicating a capacitance value.

Thus, the image forming apparatus can detect the position of the sheet cassette in the main body and the remaining amount of sheets in the sheet cassette accurately using a single sensor.

DETAILED DESCRIPTION

A first illustrative embodiment will be described with reference to the accompany drawings.

Overall Structure

As illustrated in FIGS. 1, 2, 3, and 4, an image forming apparatus 1 includes a casing 11 as an example of a main body. The casing 11 defines an outer appearance of the image forming apparatus 1.

A sheet cassette 12 is disposed in a bottom portion of the casing 11. The bottom portion of the casing 11 defines an installation position P of the sheet cassette 12 in which sheets are feedable from the sheet cassette 12 toward an image forming unit 18. The sheet cassette 12 is inserted into the casing 11 from one side, e.g., front side, of the casing 11 toward the installation position P. The sheet cassette 12 at the installation position P is removable from the casing 11 by being pulled to the one side of the casing 11.

In the following description, one side of the casing 11, that is, a side from which the sheet cassette 12 is removed from the installation position P (a left side of FIG. 1) may be referred to as a front side, and its opposite side will be referred to as a rear side. Left and right sides of the image forming apparatus 1 may be identified as viewed from a user in front of the image forming apparatus 1. A direction orthogonal to a front-rear direction and a left-right direction may be an up-down direction, and up and down or upper and lower sides of the image forming apparatus 1 may be identified in conjunction with an orientation in which the image forming apparatus 1 is placed in a horizontal plane.

Figure 1:
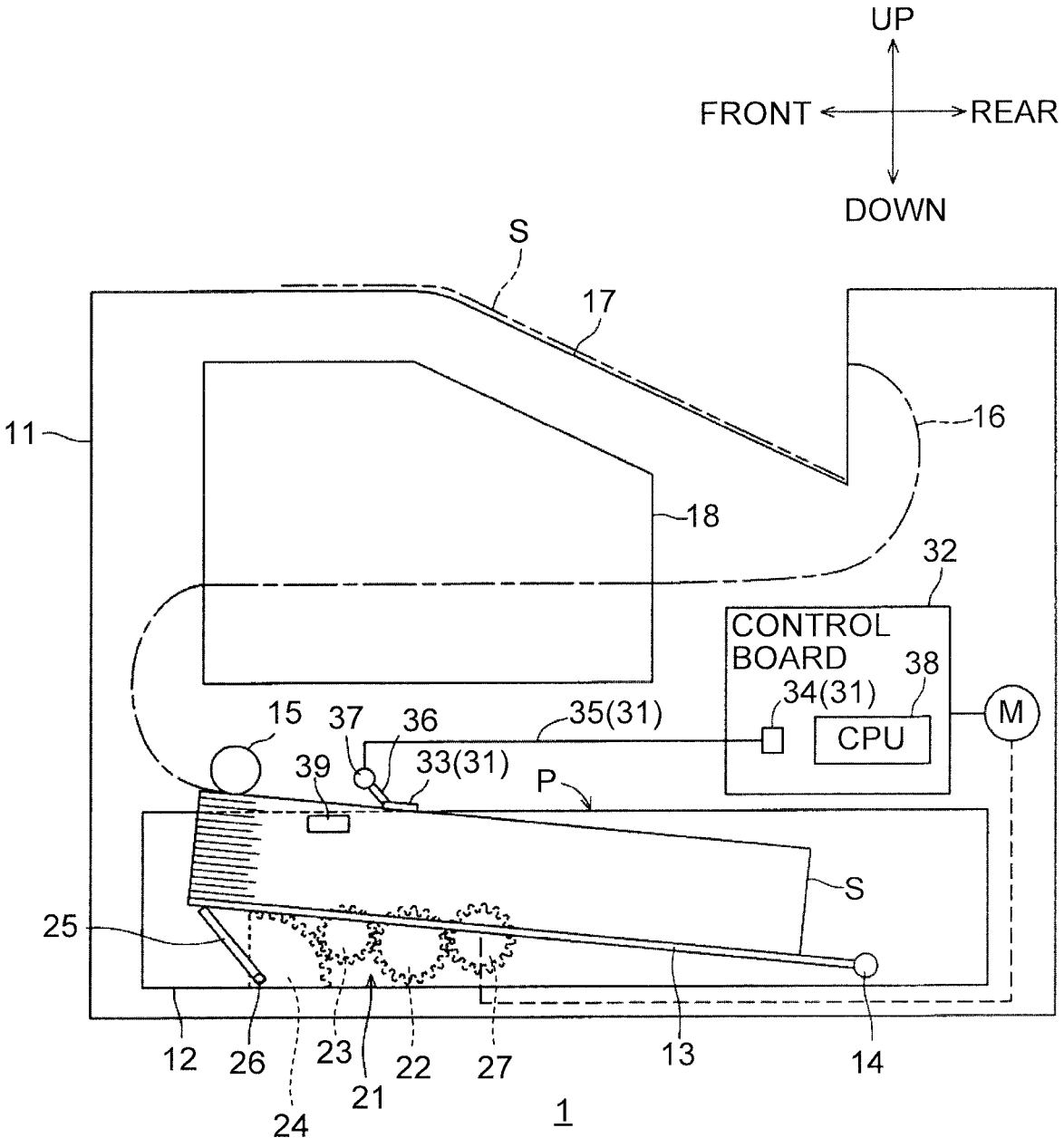
FIG. 1 is a cross sectional view schematically illustrating an image forming apparatus according to a first illustrative embodiment of the disclosure, wherein a sheet cassette is at its installation position and a sheet supporting plate is at its up position.

The sheet cassette 12 is configured to hold a stack of sheets S therein. The sheet cassette 12 includes a sheet supporting plate 13 that supports one or more sheets S from below. The sheet supporting plate 13 is made of metal. The sheet supporting plate 13 includes a shaft 14. The shaft 14 is supported by the sheet cassette 12 rotatably. As illustrated in FIG. 1, the sheet supporting plate 13 is pivotable about the shaft 14 between an up position in which a front end portion of the sheet supporting plate 13 ascends from a bottom surface of the sheet cassette 12 and a down position illustrated in FIG. 4 in which the sheet supporting plate 13 extends along the bottom surface of the sheet cassette 12. As the sheet supporting plate 13 pivots, leading ends of the sheets S supported on the sheet supporting plate 13 moves up and down.

A feed roller 15 is disposed in the casing 11. The feed roller 15 is disposed at a front end portion of the casing 11 and above the installation position P. When the sheet cassette 12 is installed at the installation position P and the sheet supporting plate 13 is in the down position, no sheets S supported on the sheet supporting plate 13 contact the feed roller 15. When the sheet supporting plate 13 moves from the down position to the up position, a front end portion of an uppermost sheet S contacts the feed roller 15 from below.

In this state, upon rotation of the feed roller 15, the uppermost sheet S is fed from the sheet cassette 12 toward a conveyance path 16 defined in the casing 11. The casing 11 has a recessed portion at its upper surface. The recessed portion has a bottom surface inclined down to the rear to serve as a sheet discharge tray 17. The conveyance path 16 is curved upward to the front from the feed roller 15, extends straightly to the rear, is curved upward to the rear, and then is open at a rear end of the sheet discharge tray 17. The image forming unit 18 to form an image on a sheet S is disposed in the casing 11. The conveyance path 16 passes through the image forming unit 18. A sheet S fed from the sheet cassette 12 is conveyed along the conveyance path 16 through the image forming unit 18 toward the sheet discharge tray 17. As the sheet S passes through the image forming unit 18, an image is formed on the sheet S. The sheet S having the image thereon is discharged from the conveyance path 16 to the sheet discharge tray 17. A subsequent sheet S is discharged and stacked onto the discharged sheet S remaining on the sheet discharge tray 17.

The image forming unit 18 may form an image based on electrography or ink jet printing.

Sheet Supporting Plate Moving Mechanism

The sheet cassette 12 includes a sheet supporting plate moving mechanism 21 that moves the sheet supporting plate 13 between the up position and the down position. The sheet supporting plate moving mechanism 21 includes a driven gear 22, a transmission gear 23, a sector gear 24, and a push member 25.

The driven gear 22, the transmission gear 23, and the sector gear 24 are disposed on, for example, a left-side outer surface of the sheet cassette 12. The driven gear 22 and the transmission gear 23 are supported by the sheet cassette 12 so as to be rotatable about their respective axes extending in the left-right direction. The transmission gear 23 is located in front of the driven gear 22 and in mesh with the driven gear 22. The sector gear 24 is a fan-shaped plate member and has, near its center, a rotation shaft 26 that extends in the left-right direction and is inserted through the sector gear 24. The rotation shaft 26 is not rotatable relative to the sector gear 24. The sector gear 24 is located in front of the transmission gear 23 and in mesh with the transmission gear 23. The rotation shaft 26 is rotatably supported by the sheet cassette 12. The push member 25 is disposed below the sheet supporting plate 13. The push member 25 has one end portion supported by the rotation shaft 26 so as not to be rotatable relative thereto. The push member 25 extends from the rotation shaft 26 toward the front and has a front end portion in contact with the sheet supporting plate 13 from below.

A drive gear 27 is disposed in the casing 11 in correspondence with the driven gear 22 so as to be rotatable about an axis extending in the left-right direction. The drive gear 27 receives power from a motor M as an example of a drive source.

Figure 4:
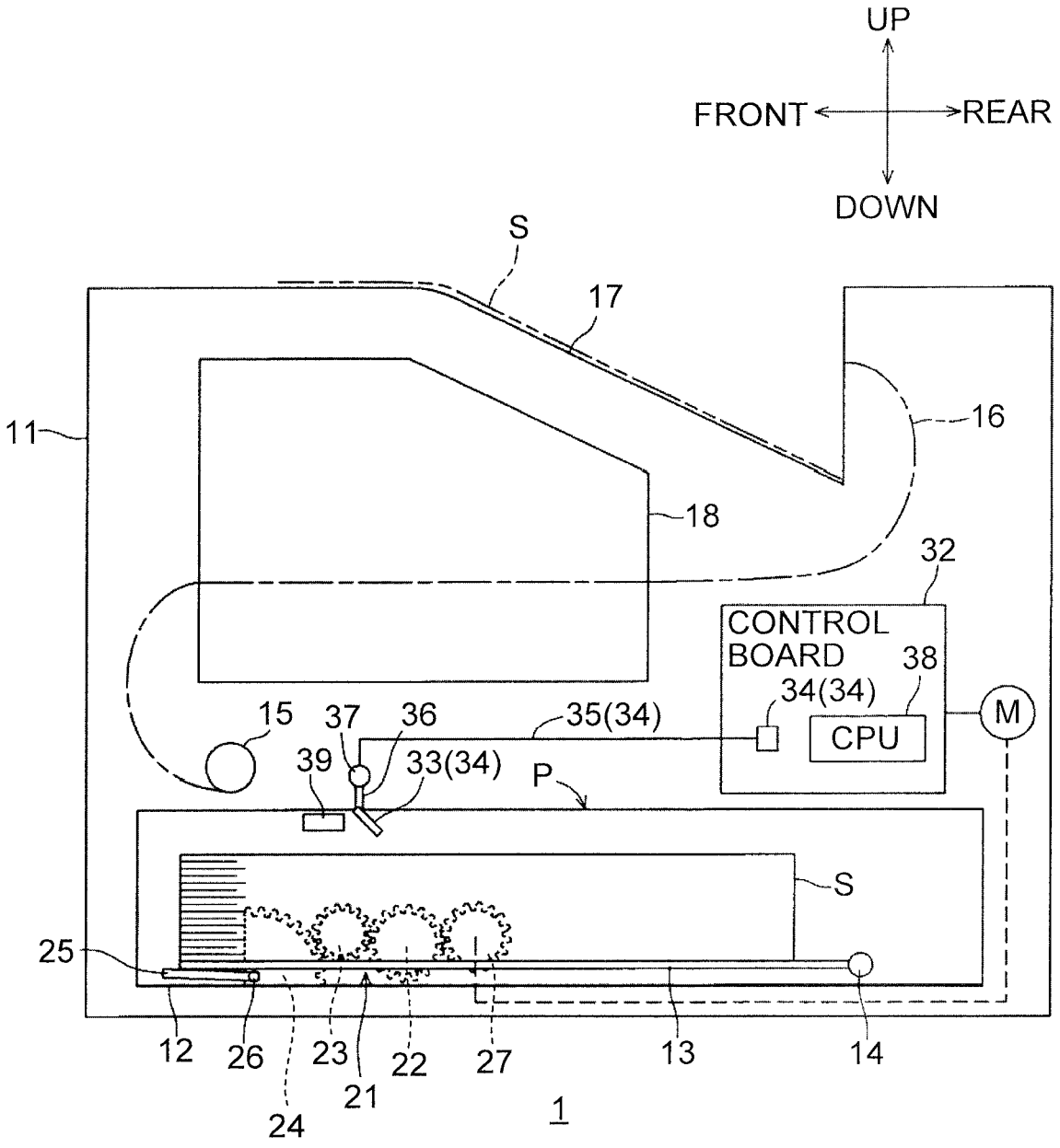
FIG. 4 is a cross sectional view of the image forming apparatus, wherein the sheet cassette is at its installation position and the sheet supporting plate is at its down position.

The sheet supporting plate 13 rises from the down position to the up position in a state in which the sheet cassette 12 is installed at the installation position P. In response to the sheet cassette 12 installed at the installation position P, the driven gear 22 of the sheet cassette 12 meshes with the drive gear 27 disposed in the casing 11. As illustrated in FIG. 4, the sheet supporting plate 13 is in the down position immediately after the sheet cassette 12 is installed at the installation position P. The motor M transmits a driving force to the drive gear 27, allowing the drive gear 27 to rotate counterclockwise in FIG. 4 and the driven gear 22 to rotate clockwise in FIG. 4. Upon rotation of the driven gear 22, the transmission gear 23 rotates counterclockwise in FIG. 4 and the sector gear 24 rotates clockwise in FIG. 4. Upon rotation of the sector gear 24, the front end portion of the push member 25 pushes the sheet supporting plate 13 up from below while moving upward. The sheet supporting plate 13 thus pivots about the shaft 14 from the down position to the up position illustrated in FIG. 1.

The sheet supporting plate 13 may lower from the up position to the down position by rotating the drive gear 27 in a direction opposite to that in which the sheet supporting plate 13 rises. Alternatively, the sheet supporting plate 13 may lower from the up position to the down position by its own weight when the driven gear 22 and the drive gear 27 disengage from each other as the sheet cassette 12 is moved from the installation position P toward the front.

Principal Structure

A capacitive sensor 31 and a control board 32 are disposed in the casing 11. The capacitive sensor 31 includes an electrode 33, a capacitance detector 34, and a harness 35 as an example of a wire.

The electrode 33 has a plate shape and is attached to one end of an electrode holder 36. An arm shaft 37 is disposed to the rear of the feed roller 15 in the casing 11. The arm shaft 37 extends in the left-right direction, for example, from a left side wall of the casing 11 to a position above the installation position P. The other end of the electrode holder 36 is supported at a portion of the arm shaft 37 facing the installation position P in the up-down direction such that the electrode holder 36 is rotatable relative to the arm shaft 37.

The capacitance detector 34 is contained on the control board 32. The capacitance detector 34 is electrically connected to the electrode 33 via the harness 35. The capacitance detector 34 outputs a signal corresponding to a quantity of electricity stored in the electrode 33, more specifically, a signal indicating a capacitance value C corresponding to a quantity of electricity stored in the electrode.

The control board 32 contains a CPU 38, as an example of a controller, thereon. The CPU 38 detects a capacitance value C from a signal outputted from the capacitance detector 34. In addition to the capacitance detector 34 and the CPU 38, the control board 32 contains thereon electronic parts including nonvolatile and volatile memory chips, which are required for controlling each part of the image forming apparatus 1. The CPU 38 may be integrated in an ASIC (Application Specific Integrated Circuit) together with the nonvolatile and volatile memory chips, and the ASIC may be contained on the control board 32.

The sheet cassette 12 includes a metal member 39 in a front portion of its left-side inner surface. The metal member 39 has an appropriate thickness in the left-right direction so as not to contact the sheets S supported on the sheet supporting plate 13.

Figure 2:
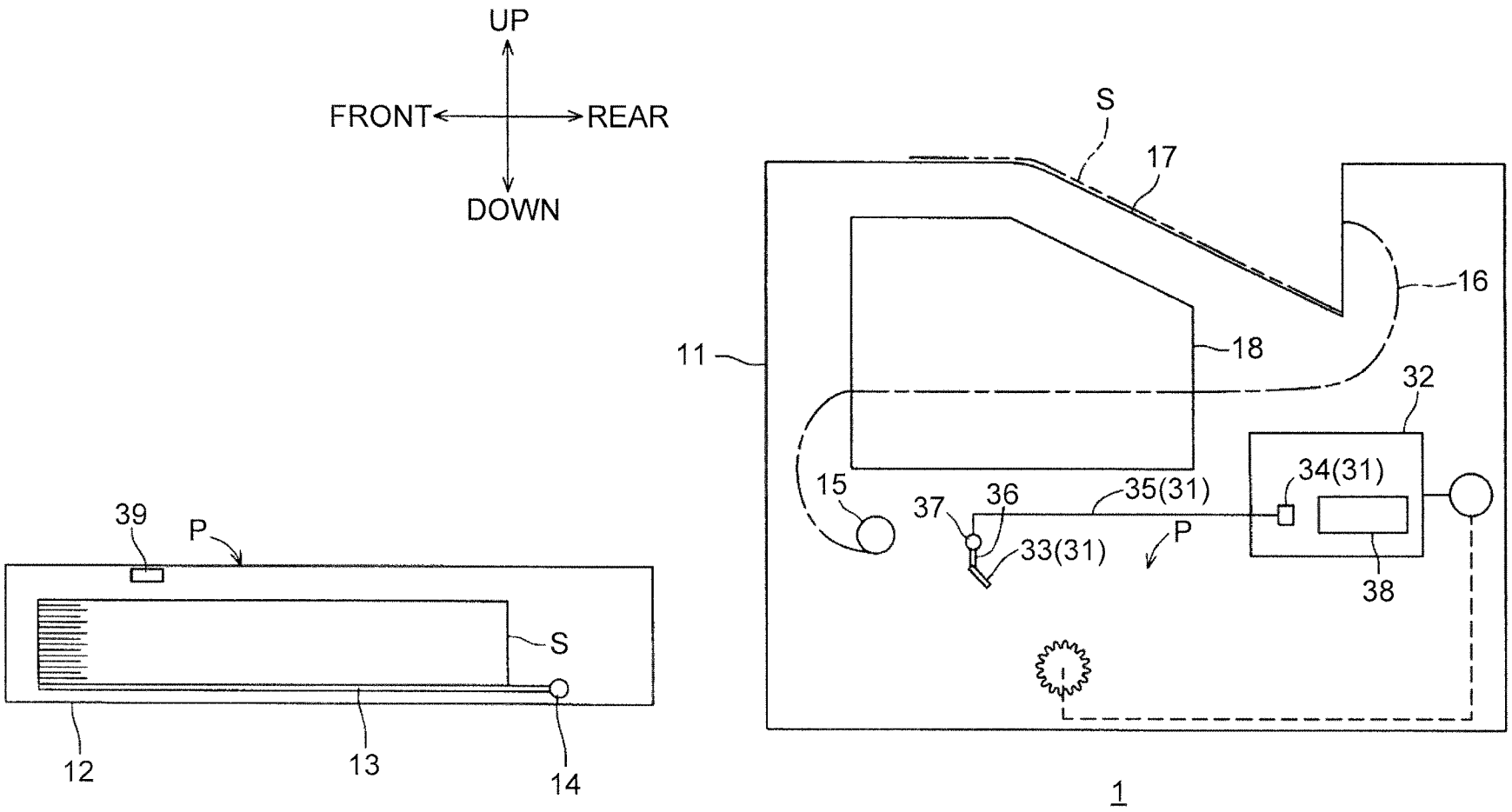
FIG. 2 is a cross sectional view of the image forming apparatus, wherein the sheet cassette is removed from a casing of the image forming apparatus.
Figure 3:
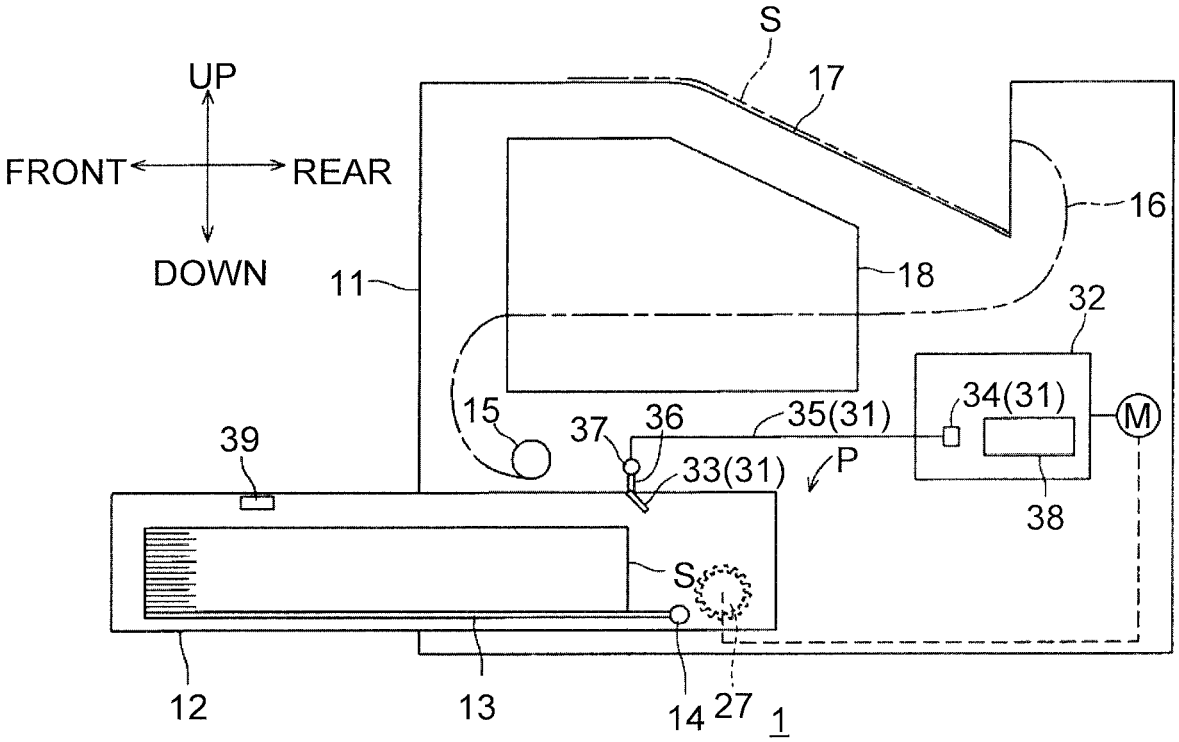
FIG. 3 is a cross sectional view of the image forming apparatus, wherein the sheet cassette moves toward the installation position.

The length of the electrode holder 36 and the position of the arm shaft 37 are appropriately designed such that, when the sheet supporting plate 13 of the sheet cassette 12 is at the down position as illustrated in FIGS. 2, 3, and 4, the electrode holder 36 extends vertically downward from the arm shaft 37 and the electrode 33 is in a position away from a sheet S on the sheet supporting plate 13 regardless of whether the sheet cassette 12 is installed in the installation position P. In a state in which the electrode holder 36 extends downward, the electrode 33 extends from an end portion of the electrode holder 36 to the left and faces the metal member 39 in the front-rear direction. As illustrated in FIG. 4, in a state where the sheet cassette 12 is at the installation position P, the electrode 33 faces the sheet supporting plate 13 via the sheets S therebetween in the up-down direction, and is spaced from the metal member 39 in the front-rear direction. In this state, a distance between the electrode 33 and the metal member 39 in the front-rear direction is minimal. When the sheet cassette 12 is located at the installation position P and the sheet supporting plate 13 rises from the down position to the up position illustrated in FIG. 1, an uppermost sheet S supported on the sheet supporting plate 13 contacts and raises the electrode 33, causing the electrode holder 36 to pivot about the arm shaft 37. Pivoting of the electrode holder 36 allows the electrode 33 to move close to the sheet supporting plate 13 in parallel therewith. When a predetermined maximum number of sheets S are supported on the sheet supporting plate 13, the electrode 33 may become parallel to the sheet supporting plate 13.

The electrode 33 is fixed to the electrode holder 36, but may be rotatable about an axis extending in the left-right direction relative to the electrode holder 36. In this case, when contacting a sheet S, the electrode 33 may become parallel to the sheet supporting plate 13 regardless of amount of sheets S supported on the sheet supporting plate 13.

Sheet Cassette State Determination Process

Figure 5:
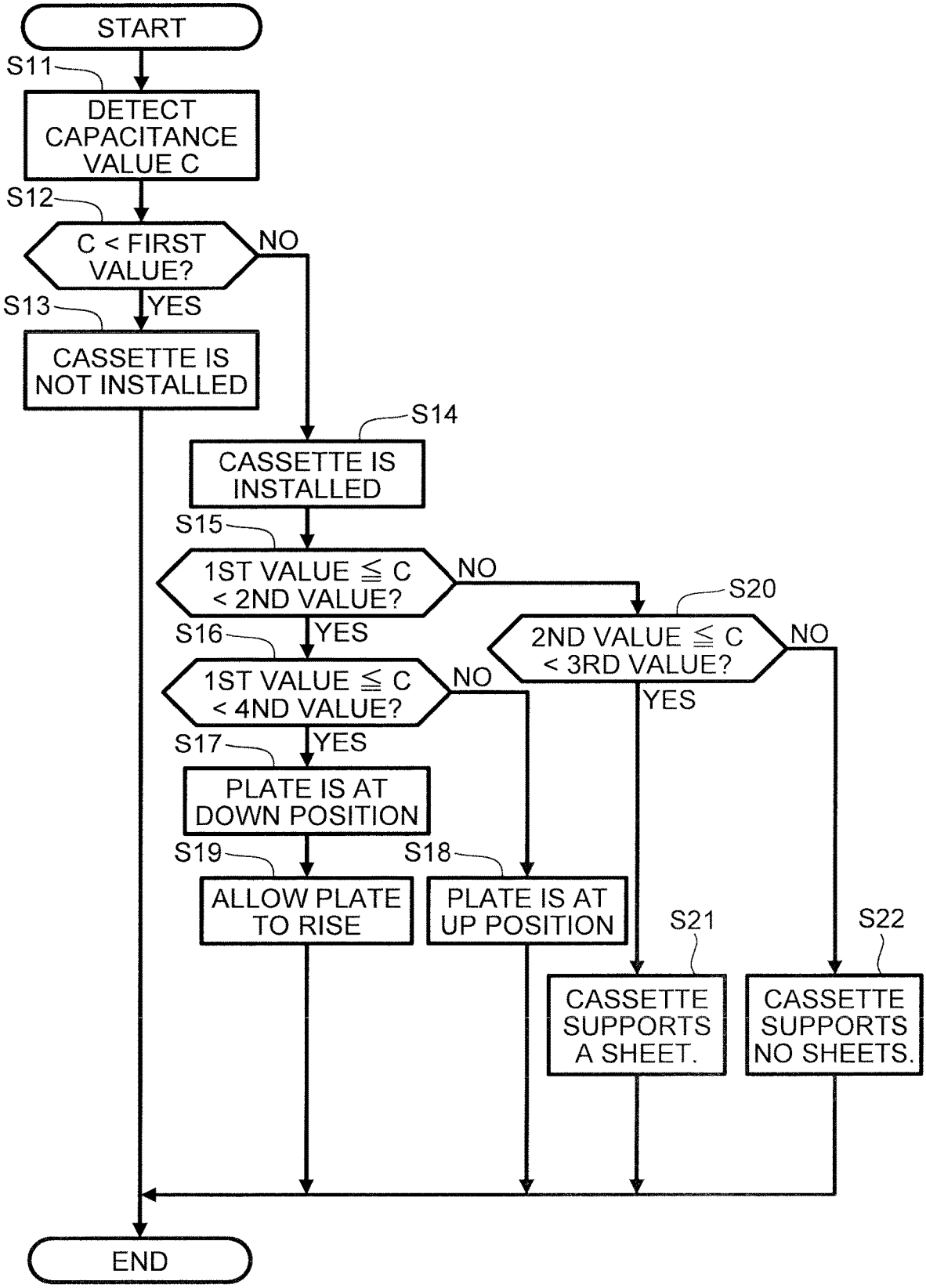
FIG. 5 is a flowchart of a sheet cassette state determination process.

While the image forming apparatus 1 is powered on, the CPU 38 executes a sheet cassette state determination process illustrated in FIG. 5 cyclically at particular intervals.

The sheet cassette state determination process may begin with the CPU 38, which first may detect a capacitance value C from a signal outputted from the capacitance detector 34 (S11).

Figure 6:
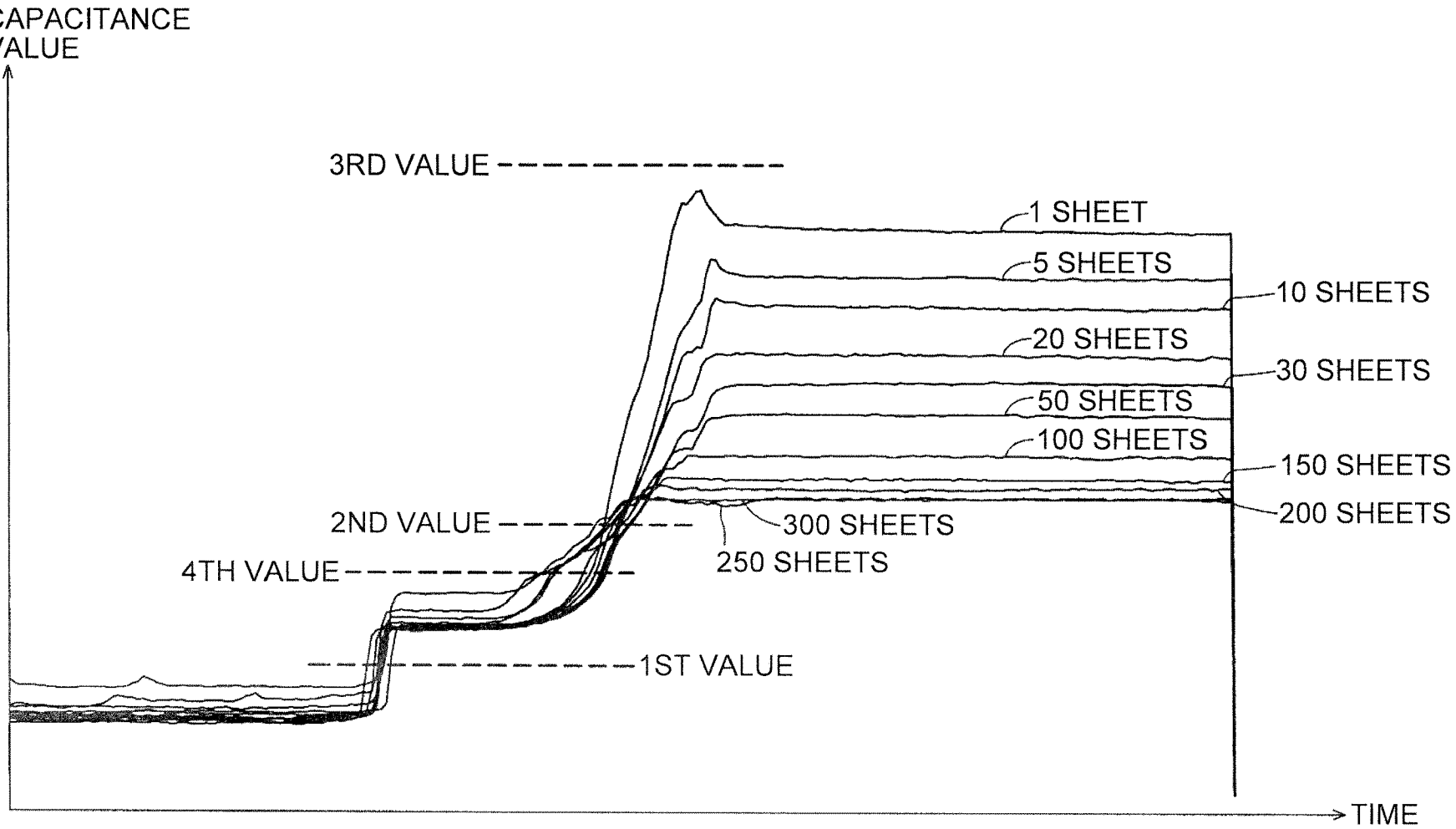
FIG. 6 is a graph illustrating changes in capacitance value over time when the sheet cassette is at the installation position.

The CPU 38 then determines whether the detected capacitance value C is below a first value (S12). As illustrated in FIG. 2, in a state where the sheet cassette 12 is removed from the casing 11, the casing 11 is devoid of a conductor, which forms a pseudocapacitor with the electrode 33, around the electrode 33. In this state, as illustrated in FIG. 6, the capacitance value C is smaller than the first value irrespective of the amount of sheets S supported on the sheet supporting plate 13 of the sheet cassette 12. In a case in which the CPU 38 determines that the capacitance value C is below the first value (S12: YES), the CPU 38 determines that the sheet cassette 12 is removed from the casing 11 and the sheet cassette 12 is not yet installed at the installation position P (S13: CASSETTE IS NOT INSTALLED).

As illustrated in FIG. 3, as the sheet cassette 12 is inserted into the casing 11 toward the installation position P, the sheet supporting plate 13 of the sheet cassette 12 faces the electrode 33 in the casing 11 in the up-down direction. The sheet supporting plate 13 and the electrode 33 form a pseudocapacitor in which an electrical charge is stored. The metal member 39 of the sheet cassette 12 faces the electrode 33 in the front-rear direction, and the electrode 33 and the metal member 39 form a pseudocapacitor in which an electrical charge is stored. The pseudocapacitor has a capacitance value which becomes greater as the metal member 39 moves closer to the electrode 33. The pseudocapacitor formed by the sheet supporting plate 13 and the electrode 33 and the pseudocapacitor formed by the electrode 33 and the metal member 39 are connected in parallel with each other. As the sheet cassette 12 approaches the installation position P, the amount of electricity in the electrode 33 increases and the capacitance value C detected from the signal outputted from the capacitance detector 34 thus increases. In a state in which the sheet cassette 12 is at the installation position P, the capacitance value C exceeds the first value as illustrated in FIG. 6.

When the CPU 38 determines that the capacitance value C is greater than or equal to the first value (S12: NO), the CPU 38 determines that the sheet cassette 12 is at the installation position P (S14) and then determines whether the capacitance value C thereat is below a second value (S15). The second value is greater than the first value. The second value is set to a value greater than the capacitance value C detected from a signal outputted from the capacitance detector 34 in a state in which the sheet supporting plate 13 supporting the predetermined maximum number of sheets S thereon is at the up position.

The CPU 38 then determines whether the capacitance value C detected from the signal outputted from the capacitance detector 34 is below a fourth value (S16). As illustrated in FIG. 6, the fourth value is set to a value that is beyond the first value and below the second value. In a process where the sheet supporting plate 13 moves from the down position to the up position, the fourth value is exceeded by the capacitance value C that increases as the sheet supporting plate 13 approaches the electrode 33. In a case in which the CPU 38 determines that the capacitance value C is below the fourth value (S16: YES), the CPU 38 determines that the sheet supporting plate 13 is located at the down position (S17). In a case in which the CPU 38 determines that the capacitance value C is greater than or equal to the fourth value (S16: NO), the CPU 38 determines that the sheet supporting plate 13 located at the up position (S18).

In a case in which the CPU 38 determines that the sheet supporting plate 13 is located at the down position, the CPU 38 allows the sheet supporting plate 13 to rise from the down position to the up position (S19). Allowance of the upward movement of the sheet supporting plate 13 means that the CPU 38 sets "1" to a flag in volatile memory not illustrated. In response to that "1" is set to the flag, for example, the driving force of the motor M may be transmitted to the drive gear 27, and the sheet supporting plate 13 may move up from the down position to the up position.

In a state in which the sheet supporting plate 13 is located at the up position, the capacitance value C detected from the output signal of the capacitance detector 34 exceeds the second value, as illustrated in FIG. 6, even when the sheet supporting plate 13 supports thereon the predetermined maximum number of sheets S. When the sheet supporting plate 13 supports thereon at least one sheet S, the electrode 33 does not directly contact the sheet supporting plate 13, and thus the capacitance value C detected from the signal outputted from the capacitance detector 34 does not exceed a third value. When the sheet supporting plate 13 supports thereon no sheets S or the sheet cassette 12 is empty, the sheet supporting plate 13 directly contacts the electrode 33 and thus the capacitance value C detected from the signal outputted from the capacitance detector 34 exceeds the third value. In a case in which the CPU 38 determines that the capacitance value C is greater than or equal to the second value, the CPU 38 determines whether the capacitance value C is below the third value (S20). In a case in which the CPU 38 determines that the capacitance value C is below the third value (S20: YES), the CPU 38 determines that the sheet cassette 12 supports a sheet S (S21). In a case in which the CPU 38 determines that the capacitance value C is greater than or equal to the third value (S20: NO), the CPU 38 determines that the sheet cassette 12 supports no sheets S (S22).

In a case in which the capacitance value C detected from the signal outputted from the capacitance detector 34 is greater than or equal to the second value and below the third value, that is, sheet supporting plate 13 supporting one or more sheets S thereon is located at the up position, the capacitance value C is smaller the greater the number of sheets S supported on the sheet supporting plate 13 is, and the capacitance value C is greater as the smaller the number of sheets S is. The CPU 38 thus determines the amount (or the number) of sheets S remaining in the sheet cassette 12 from the capacitance value C.

Effects

As described above, the presence or absence of the sheet cassette 12 at the installation position P in the casing 11 and the remaining amount of sheets S supported on the sheet cassette 12 are determined from the capacitance value C detected from the signal outputted from the capacitance detector 34 that is connected to the electrode 33 via the harness 35. In a case in which the capacitance value C is below the first value, the CPU 38 determines that the sheet cassette 12 is not installed at the installation position P. In a case in which the capacitance value C is greater than or equal to the first value and below the second value, the CPU 38 determines that the sheet cassette 12 is installed at the installation position P. In a case in which the capacitance value C is greater than or equal to the second value and below the third value, the CPU 38 determines that the sheet cassette 12 has one or more sheets S. The position of the sheet cassette 12 in the casing 11 and the remaining amount of sheets S can be detected by using the single capacitive sensor 12 including the electrode 33, the capacitance detector 34, and the harness 35 connecting the electrode 33 and the capacitance detector 34. The position of the sheet cassette 12 in the casing 11 and the remaining amount of sheets S are determined in accordance with a level of a value of a signal outputted from the capacitance detector 34, and thus can be detected accurately as compared with the known structure.

Thus, the position of the sheet cassette 12 in the casing 11 and the remaining amount of sheets S can be detected accurately by using the single capacitive sensor 31.

The second value is set to a value greater than the capacitance value C detected from a signal outputted from the capacitance detector 34 in a state in which the sheet supporting plate 13 supporting the predetermined maximum number of sheets S thereon is at the up position. The electrode 33 is disposed such that, when the predetermined maximum number of sheets S are supported on the sheet supporting plate 13, the electrode 33 may contact the uppermost sheet S and become parallel to the sheet supporting plate 13. The second value can be thus set to a great value as compared with a structure where the electrode 33 does not become parallel to the sheet supporting plate 13 supporting the predetermined maximum number of sheets S. This can make a big difference between the first value and the second value, thus facilitating setting of the fourth value within a range from the first value to the second value.

Furthermore, the capacitance value C can be used to determine that the sheet supporting plate 13 of the sheet cassette 12 is at the up position or down position. Thus, the single capacitive sensor 31 can be used not only to detect the position of the sheet cassette 12 in the casing 11 and the remaining amount of sheets S accurately but also to determine the position of the sheet supporting plate 13.

In a case in which the sheet cassette 12 is at the installation position P and the capacitance value C exceeds the first value, the sheet supporting plate 13 is allowed to rise from the down position. This eliminates unnecessary transmission of a driving force of the motor M to the drive gear 27 when the sheet cassette 12 is not at the installation position P.

A driving force of the motor M is transmitted to the drive gear 27, allowing the sheet supporting plate 13 to move from the up position to the down position. In this structure, to eliminate unnecessary transmission of the driving force of the motor M to the drive gear 27, the sheet supporting plate 13 may be allowed to move down to the down position in a case in which the capacitance value C exceeds the fourth value.

The electrode 33 is disposed at a position such that, when the sheet supporting plate 13 is at the installation position P, the electrode 33 is spaced from the uppermost sheet S supported on the sheet supporting plate 13 located at the down position. Thus, the electrode 33 does not contact an upper surface of the uppermost sheet S supported on the sheet supporting plate 13 during the installation of the sheet cassette 12 into the installation position P. This prevents variations in the capacitance value C caused by contact between the electrode 33 and the upper surface of the uppermost sheet S during the installation of the sheet cassette 12, which may result in detection of the capacitance value C exceeding the first value. This eliminates improper determination of whether the sheet cassette 12 is at the installation position P, thus leading to accurate determination of whether the sheet cassette 12 is in or out of the casing 11.

Second Embodiment

The above embodiment illustrates the structure that, as the sheet cassette 12 approaches the installation position P, the metal member 39 attached to the sheet cassette 12 approaches the electrode 33 facing in the front-rear direction. In addition to this structure, a structure illustrated in FIGS. 7 and 8 may be applied to the image forming apparatus 1.

Figure 7:
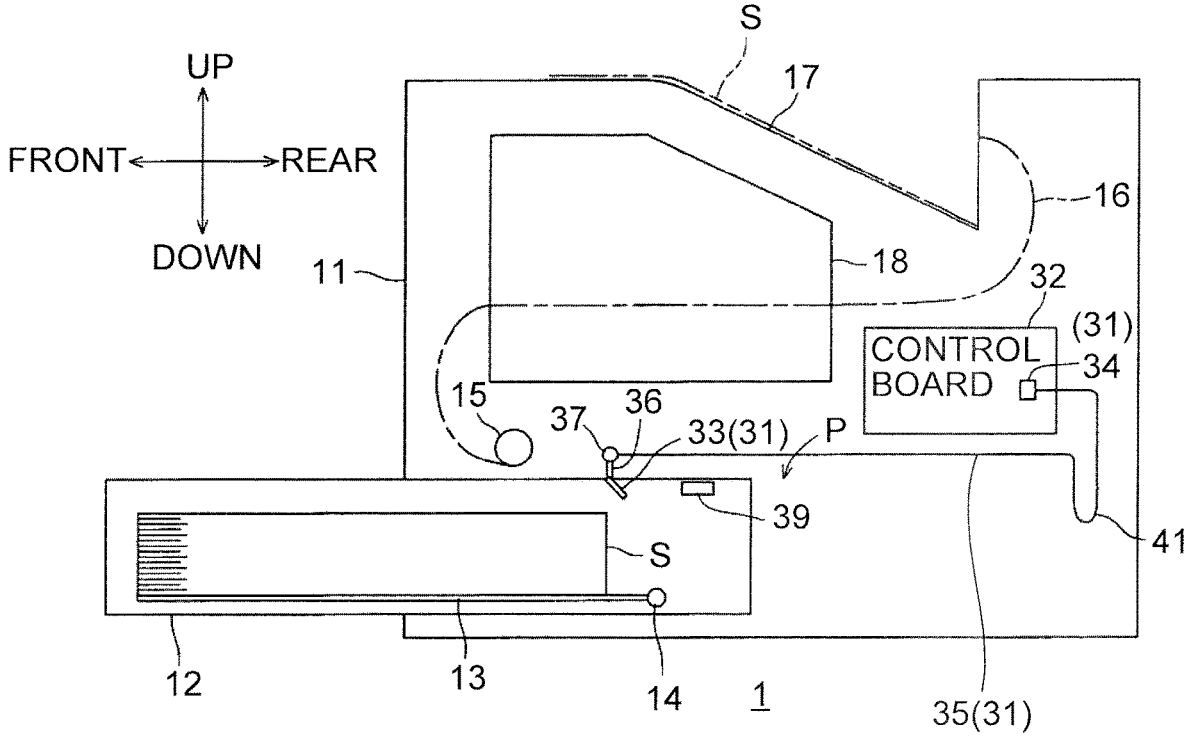
FIG. 7 is a cross sectional view schematically illustrating an image forming apparatus according to a second illustrative embodiment of the disclosure, wherein a sheet cassette moves toward its installation position.
Figure 8:
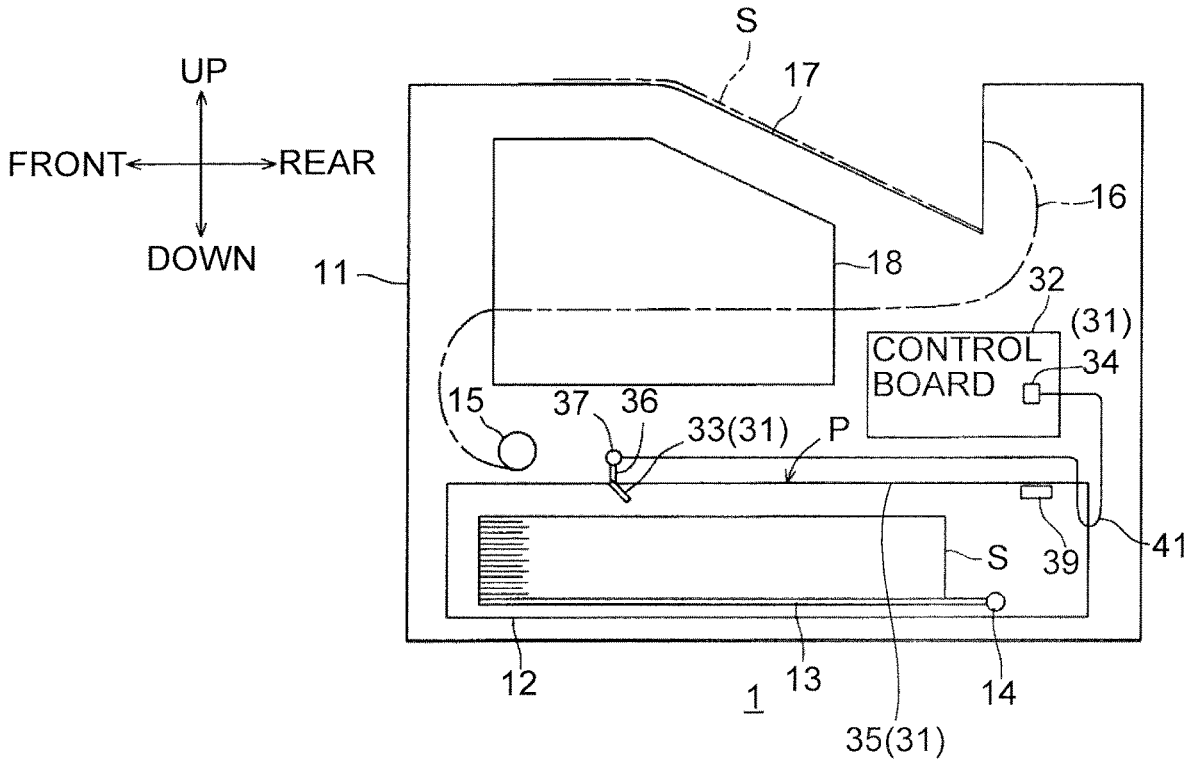
FIG. 8 is a cross sectional view of the image forming apparatus, wherein the sheet cassette is at its installation position and a sheet supporting plate is at its down position.

In the second embodiment illustrated in FIGS. 7 and 8, common components or elements have the same reference numerals as those of the first embodiment, and the detailed description of the common components or elements is omitted. In the second embodiment, for example, a harness 35 has a wavy middle portion 41 that is bent repetitively in the up-down direction. The middle portion 41 is located in a rear end portion of the casing 11 and at a position facing the metal member 39 of the sheet cassette 12 in the front-rear direction. The metal member 39 is disposed in a rear end portion of the sheet cassette 12. A particular portion of the harness 35 between the electrode 33 and the middle portion 41 is spaced from the upper surface of the sheet cassette 12 in the up-down direction by a particular distance, for example, 40 mm, or more.

As illustrated in FIG. 7, as the sheet cassette 12 is inserted into the casing 11 toward the installation position P, the sheet supporting plate 13 of the sheet cassette 12 faces the electrode 33 in the casing 11 in the up-down direction. The sheet supporting plate 13 and the electrode 33 form a pseudocapacitor in which an electrical charge is stored. The metal member 39 of the sheet cassette 12 faces the middle portion 41 of the harness 35 in the front-rear direction, and the electrode 41 of the harness 35 and the metal member 39 form a pseudocapacitor in which an electrical charge is stored. The pseudocapacitor has a capacitance value which becomes greater as the metal member 39 moves closer to the middle portion 41 of the harness 35. Depending on the size of the metal member 39 and the thickness (or projected area) of the harness 35, the distance between the metal member 39 and the middle portion 41 of the harness 35 is preferably set to 5 mm or less. In that state, the distance between the metal member 39 and the middle portion 41 of the harness 35 is minimal. The pseudocapacitor formed by the sheet supporting plate 13 and the electrode 33 and the pseudocapacitor formed by the middle portion 41 of the harness 35 and the metal member 39 are connected in parallel with each other. As the sheet cassette 12 approaches the installation position P, the capacitance value C detected from the signal outputted from the capacitance detector 34 increases. In a state in which the sheet cassette 12 is at the installation position P as illustrated in FIG. 8, the capacitance value C exceeds the first value as illustrated in FIG. 6.

According to the second embodiment illustrated in FIGS. 7 and 8, the similar effects to those achieved by the first embodiment illustrated in FIG. 1 may be achieved.

The particular portion of the harness 35 between the electrode 33 and the middle portion 41 is spaced from the upper surface of the sheet cassette 12 by the particular distance or more. This prevents the capacitance value C from exceeding the first value before the sheet cassette 12 arrives the installation position P, although the electrode 33 and the portion of the harness 35 between the electrode 33 and the middle portion 41 form a pseudocapacitor. In other words, another portion of the harness 35 except for the particular portion of the harness 35 between the electrode 33 and the middle portion 41 is located such that, in a state in which the sheet cassette 12 is at the installation position P, the capacitance value C becomes the first value or less.

The middle portion 41 of the harness 35 may be located at a rear position further than a position illustrated in FIGS. 7 and 8, and the metal member 39 may be disposed at a rear end surface of the sheet cassette 12.

Third Embodiment

Figure 9:
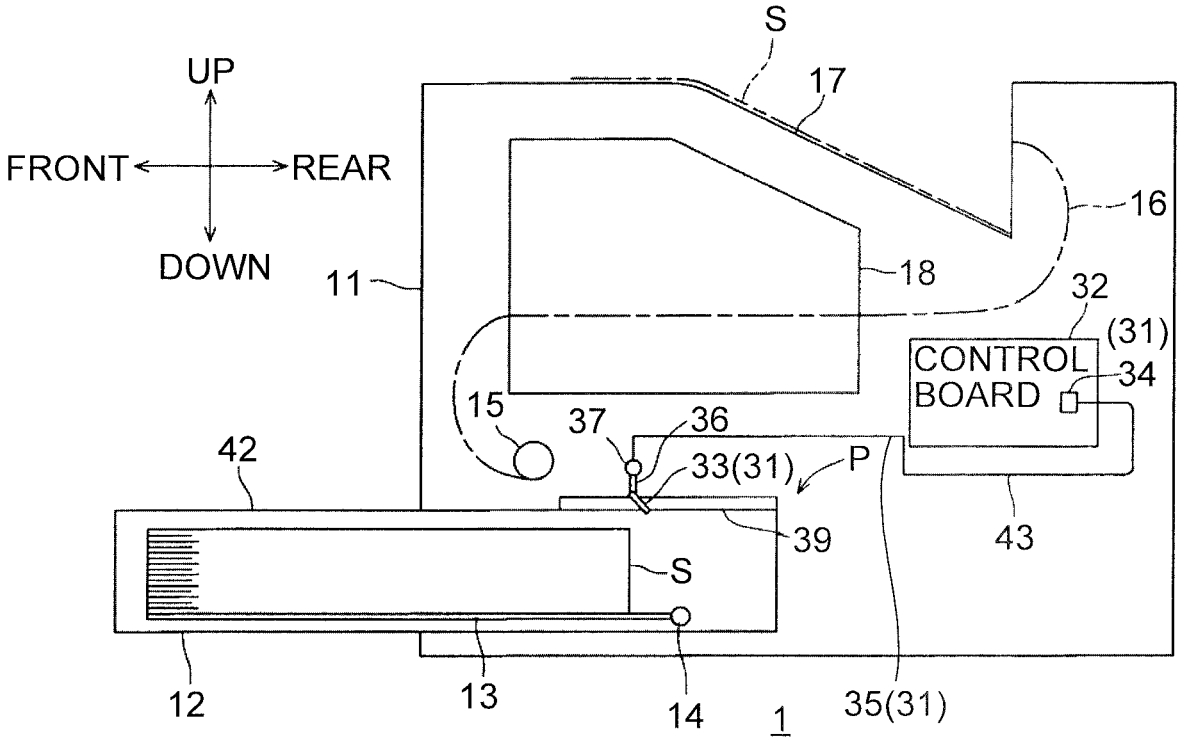
FIG. 9 is a cross sectional view schematically illustrating an image forming apparatus according to a third illustrative embodiment of the disclosure, wherein a sheet cassette moves toward its installation position.
Figure 10:
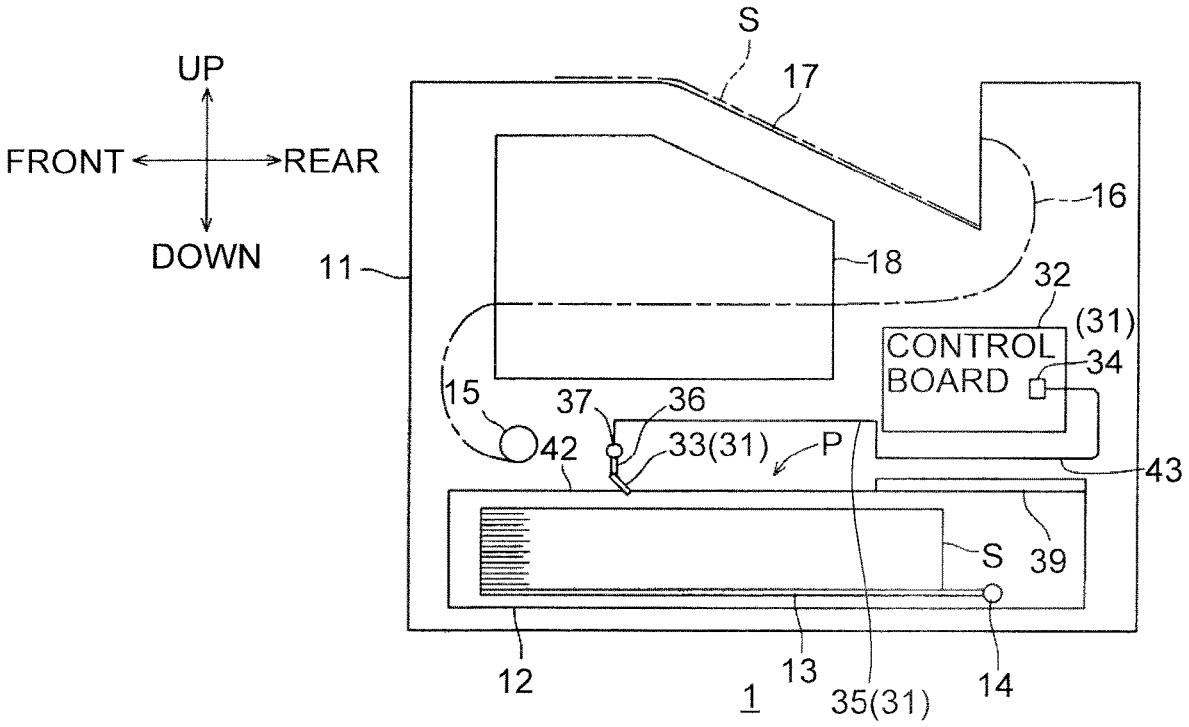
FIG. 10 is a cross sectional view of the image forming apparatus, wherein the sheet cassette is at its installation position and a sheet supporting plate is at its down position.

A structure illustrated in FIGS. 9 and 10 may be applied to the image forming apparatus 1.

In the third embodiment illustrated in FIGS. 9 and 10, common components or elements have the same reference numerals as those of the first embodiment, and the detailed description of the common components or elements is omitted. In the third embodiment, a metal member 39 is disposed at an upper surface 42 of a side surface of a sheet cassette 12, and extends in the front-rear direction. The metal member 39 extends from the rear end of the sheet cassette 12 in the front-rear direction and is about a one-third the length of the sheet cassette 12. When the sheet cassette 12 is at the installation position P, a harness 35 is located at a position facing the upper surface 42 of the side surface of the sheet cassette 12, a middle portion 43 of the harness 35 faces the metal member 39 that is disposed at the upper surface 42 of the side surface of the sheet cassette 12 with a space of 5 mm or less left in the up-down direction, and another portion of the harness 35 other than the middle portion 43 faces the upper surface 42 of the side surface of the sheet cassette 12 with a space of 40 mm or more left in the up-down direction.

As the sheet cassette 12 is inserted, the metal member 39 of the sheet cassette 12 faces the middle portion 43 of the harness 35 in the up-down direction, and the middle portion 43 of the harness 35 and the metal member 39 form a pseudocapacitor in which an electrical charge is stored. The pseudocapacitor has a capacitance value which becomes greater as an area in which the middle portion 43 of the harness 35 and the metal member 39 overlap each other increases. As illustrated in FIG. 9, as the sheet cassette 12 is inserted into the casing 11 toward the installation position P, the sheet supporting plate 13 of the sheet cassette 12 faces the electrode 33 in the casing 11 in the up-down direction. The sheet supporting plate 13 and the electrode 33 form a pseudocapacitor in which an electrical charge is stored. The pseudocapacitor formed by the sheet supporting plate 13 and the electrode 33 and the pseudocapacitor formed by the middle portion 43 of the harness 35 and the metal member 39 are connected in parallel with each other. As the sheet cassette 12 approaches the installation position P, the capacitance value C detected from the signal outputted from the capacitance detector 34 increases. In a state in which the sheet cassette 12 is at the installation position P as illustrated in FIG. 10, the capacitance value C exceeds the first value as illustrated in FIG. 6.

According to the third embodiment illustrated in FIGS. 9 and 10, the similar effects to those achieved by the first embodiment illustrated in FIG. 1 may be achieved.

While the disclosure has been described in detail with reference to the specific embodiment thereof, various changes, arrangements and modifications may be applied therein as will be described above.

What is claimed is:

1. An image forming apparatus comprising:

a main body including an electrode movable relative to the main body, a capacitance detector configured to output a signal indicating a value corresponding to a quantity of electricity stored in the electrode, and a wire connecting the electrode and the capacitance detector;

an image forming unit disposed in the main body;

a sheet cassette attachable to the main body and configured to support one or more sheets to be supplied to the image forming unit, the sheet cassette including a metal member, and a sheet supporting plate made of metal, movable relative to the sheet cassette in an up-down direction, and configured to support one or more sheets from below; and a controller disposed in the main body, wherein the main body defines an installation position in which sheets are feedable from the sheet cassette toward the image forming unit, wherein the electrode of the main body is disposed such that, in a state in which the sheet cassette is at the installation position defined in the main body, the electrode of the main body faces the sheet supporting plate in the up-down direction and the electrode is disposed immediately proximate to the metal member of the sheet supporting plate, and wherein the controller is configured to in a case in which the controller determines that the value of the signal outputted from the capacitance detector is below a first value, determine that the sheet cassette is not at the installation position in the main body, in a case in which the controller determines that the value of the signal outputted from the capacitance detector is greater than or equal to the first value and below a second value, determine that the sheet cassette is at the installation position, in a case in which the controller determines that the value of the signal outputted from the capacitance detector is greater than or equal to the second value and below a third value, determine that the sheet cassette at the installation position stores one or more sheets, and in a case in which the controller determines that the value of the signal outputted from the capacitance detector is greater than or equal to the third value, determine that the sheet cassette stores no sheets.

2. The image forming apparatus according to claim 1, wherein the electrode of the main body is disposed such that the electrode does not contact an upper surface of an uppermost sheet supported by the sheet cassette during installation of the sheet cassette into the installation position in the main body.

3. An image forming apparatus comprising:

a main body including an electrode movable relative to the main body, a capacitance detector configured to output a signal indicating a value corresponding to a quantity of electricity to be stored in the electrode, and a wire connecting the electrode and the capacitance detector;

an image forming unit disposed in the main body;

a sheet cassette attachable to the main body and configured to support one or more sheets to be supplied to the image forming unit, the sheet cassette including a metal member, and a sheet supporting plate made of metal, movable relative to the sheet cassette in an up-down direction, and configured to support one or more sheets from below; and a controller disposed in the main body, wherein the main body defines an installation position in which sheets are feedable from the sheet cassette toward the image forming unit, wherein the electrode of the main body is disposed such that, in a state in which at least the sheet cassette is at the installation position set in the main body, the electrode of the main body faces the sheet supporting plate in the up-down direction, wherein the wire has a particular portion, the particular portion being located such that, in a state in which the sheet cassette is at the installation position, a distance between the particular portion and the metal member is less than a predetermined value, and wherein the controller is configured to in a case in which the controller determines that the value of the signal outputted from the capacitance detector is below a first value, determine that the sheet cassette is not at the installation position in the main body, in a case in which the controller determines that the value of the signal outputted from the capacitance detector is greater than or equal to the first value and below a second value, determine that the sheet cassette is at the installation position, in a case in which the controller determines that the value of the signal outputted from the capacitance detector is greater than or equal to the second value and below a third value, determine that the sheet cassette at the installation position supports a sheet, and in a case in which the controller determines that the value of the signal outputted from the capacitance detector is greater than or equal to the third value, determine that the sheet cassette supports no sheets.

4. The image forming apparatus according to claim 3, wherein the particular portion of the wire is located downstream relative to the installation position in an installation direction in which the sheet cassette is installed into the main body, and wherein the metal member is disposed in a downstream end portion of the sheet cassette in the installation direction.

5. The image forming apparatus according to claim 4, wherein the particular portion of the wire is bent.

6. The image forming apparatus according to claim 4, wherein another portion of the wire other than the particular portion is located such that, in a state in which the sheet cassette is at the installation position, the value of the signal outputted from the capacitance detector is smaller or equal to the first value.

7. The image foiling apparatus according to claim 6, further comprising a drive source for producing a driving force to move the sheet supporting plate upward.

8. The image forming apparatus according to claim 7, wherein, in a case in which the controller determines that the value of the signal outputted from the capacitance detector exceeds the first value, the controller allows the drive source to produce the driving force to move the sheet supporting plate upward.

9. The image forming apparatus according to claim 7, wherein the fourth value is greater than the first value and below the second value, wherein, in a case in which the controller determines that the value of the signal outputted from the capacitance detector is below the fourth value, the controller determines that the sheet cassette is located at a down position, and wherein, in a case in which the controller determines that the value of the signal outputted from the capacitance detector is greater than or equal to the fourth value, the controller determines that the sheet cassette is located at an up position higher than the down position.

10. The image forming apparatus according to claim 3, wherein the metal member is disposed on an upper surface of the sheet cassette, and wherein, when the sheet cassette is at the installation position, the particular portion of the wire faces the metal member in the up-down direction.

11. The image forming apparatus according to claim 3, wherein the distance between the particular portion and the metal member is 5 mm or less.

* * * * *